US011063359B2

(12) United States Patent
Choon et al.

(10) Patent No.: US 11,063,359 B2
(45) Date of Patent: Jul. 13, 2021

(54) ANTENNA SYSTEM AND MOBILE TERMINAL USING SAME

(71) Applicant: AAC Technologies Pte. Ltd., Singapore (SG)

(72) Inventors: Tan Yew Choon, Singapore (SG); Ng Guan Hong, Singapore (SG); Tay Yew Siow, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 149 days.

(21) Appl. No.: 16/435,611

(22) Filed: Jun. 10, 2019

(65) Prior Publication Data

US 2019/0379121 A1 Dec. 12, 2019

(30) Foreign Application Priority Data

Jun. 12, 2018 (CN) ..... 201810601872.1

(51) Int. Cl.

| | |
|---|---|
| ***H01Q 5/357*** | (2015.01) |
| ***H01Q 1/38*** | (2006.01) |
| ***H01Q 19/02*** | (2006.01) |
| ***H01Q 21/00*** | (2006.01) |

(52) U.S. Cl.

CPC ..... *H01Q 5/357* (2015.01); *H01Q 1/38* (2013.01); *H01Q 19/025* (2013.01); *H01Q 21/0043* (2013.01)

(58) Field of Classification Search

CPC ... H01Q 5/357; H01Q 19/025; H01Q 21/0043

See application file for complete search history.

(56) References Cited

U.S. PATENT DOCUMENTS

2015/0349428 A1* 12/2015 Kashino ..... H01Q 13/106 343/770

2017/0025762 A1* 1/2017 Rahmat-Samii ..... H01Q 9/0442

* cited by examiner

*Primary Examiner* — Daniel Munoz

(74) *Attorney, Agent, or Firm* — IPro, PLLC; Na Xu

(57) ABSTRACT

The present disclosure provides an antenna system including an antenna assembly embedded in a grounding foundation plate. The antenna assembly includes a first printed circuit board, a second printed circuit board, a third printed circuit board, a first conductive layer, a feed sheet, a second conductive layer, a first radiation gap disposed in the second conductive layer, and a second radiation gap disposed in the second conductive layer. The antenna assembly further includes a feed point disposed at one end of the feed sheet for electrically connecting to an external circuit and transferring the power to the second conductive layer via the feed sheet, by which, the first radiation gap works at a first frequency band, and the second radiation gap works at a second frequency band. Both of the first and second frequency bands are included in 5G frequency bands.

8 Claims, 15 Drawing Sheets

ANTENNA SYSTEM AND MOBILE TERMINAL USING SAME

FIELD OF THE PRESENT DISCLOSURE

The present disclosure relates to the field of electromagnetic transducers, more particularly to a speaker box used in a portable electronic device.

DESCRIPTION OF RELATED ART

5 G is developed as a research and development focus of a global industry, and developing a 5 G technology has become a consensus in the industry. The International Telecommunication Union (ITU) provides a main application scene of 5 G on the 22th conference of the ITU-rwex5d on June, 2015. The ITU defines three main application scenarios: enhanced mobile broadband, large-scale machine communication, high reliability and low delay communication. The three application scenes respectively correspond to is different key indexes, wherein the peak speed of the user in the enhanced mobile bandwidth scene is 20 GBPS, and the lowest user experience rate is 100 MBPS. In order to achieve these harsh indexes, a plurality of key technologies are adopted, among which, a millimeter wave antenna technology is included.

However, in the required millimeter wave frequency band, the requirement for millimeter wave antennas with the radio frequency exceeding 20 GHz is very high. On one hand, the space loss of the wave band is large, and on the other hand, if the transmitter and the receiver are in non-line-of-sight communication, the communication link can also be interfered and even interrupted.

Therefore, it is necessary to provide an improved antenna system and a communication terminal to solve the problems mentioned above.

SUMMARY OF THE PRESENT DISCLOSURE

One of the objective of the invention is to provide a dual-waveband millimeter wave antenna system with the working frequency band of 28 GHz through 37 GHz.

Accordingly, the present disclosure provides an antenna system including an antenna assembly embedded in a grounding foundation plate. The antenna assembly comprises a first printed circuit board, a second printed circuit board, a third printed circuit board which are stacked in sequence, a first conductive layer arranged on one side of the first printed circuit board far away from the second printed circuit board, a feed sheet arranged on a side of the first printed circuit board close to the second printed circuit board, a second conductive layer arranged on one side of the third printed circuit board away from the second printed circuit board, a first radiation gap disposed in the second conductive layer, and a second radiation gap disposed in the second conductive layer. The first and second conductive layers respectively electrically connect to the grounding foundation plate. The antenna assembly further includes a feed point disposed at one end of the feed sheet for electrically connecting to an external circuit and transferring the power to the second conductive layer via the feed sheet, by which, the first radiation gap works at a first frequency band, and the second radiation gap works at a second frequency band. Both of the first and second frequency bands are included in 5 G frequency bands.

Further, the first radiation gap and the second radiation gap are both axisymmetric gaps, and the first radiation gap is symmetric about a symmetry axis of the second radiation gap.

Further, the first radiation gap is a rectangular gap, wherein the second radiation gap comprises a first radiation slot arranged in parallel with the first radiation gap and two second radiation slots vertically extending from two ends of the first radiation slot, the first radiation slot and the second radiation slots are rectangular gaps and are communicated with each other.

Further, the feed sheet is a rectangular metal sheet extending in the extension direction of the symmetry axis of the second radiation gap, the orthographic projection of the feeding sheet on the third printed circuit board is intersected with the first radiation gap and the second radiation gap.

Further, the feed point is arranged at one end, close to the first radiation gap, of the feed sheet.

Further, the first frequency band comprises 37 GHz, and the second frequency band comprises 28 GHz.

Further, the grounding foundation plate and the antenna assembly are integrally formed, wherein the grounding foundation plate further comprises a metalized through hole electrically connected with the first conductive layer and the second conductive layer.

Further, the number of the antenna assemblies is multiple, and the is antenna system is a phased array antenna system.

Further, the number of the antenna assembly is four, and the four antenna assemblies are arranged in a plane matrix mode.

The present disclosure further provides a mobile terminal comprising the antenna system mentioned above.

Compared with the related art, the antenna system provided by the invention is a dual-waveband millimeter wave antenna, so that the antenna system can cover 37 GHz and 28 GHz. The requirements of 5 G communication are met; meanwhile, the antenna system can be set as a phased array, and beam scanning can be realized in the whole direction.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

First Embodiment

Figure 1:
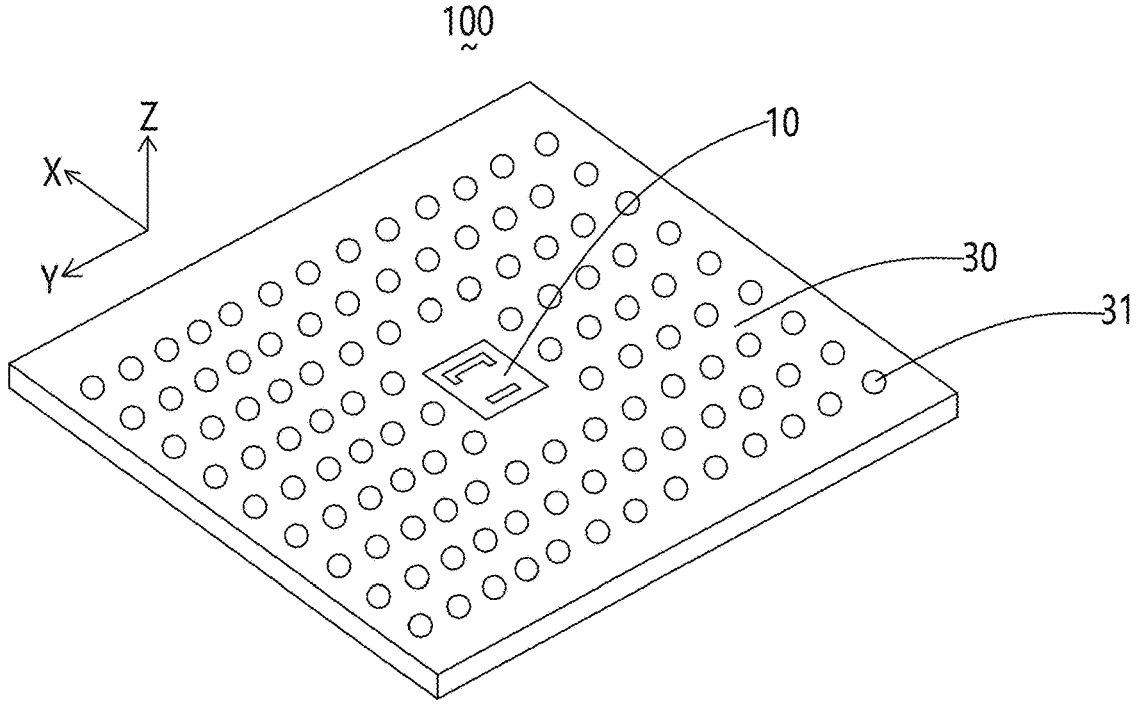
FIG. 1 is a schematic structural diagram of an antenna system in accordance with a first exemplary embodiment of the present disclosure.
Figure 2:
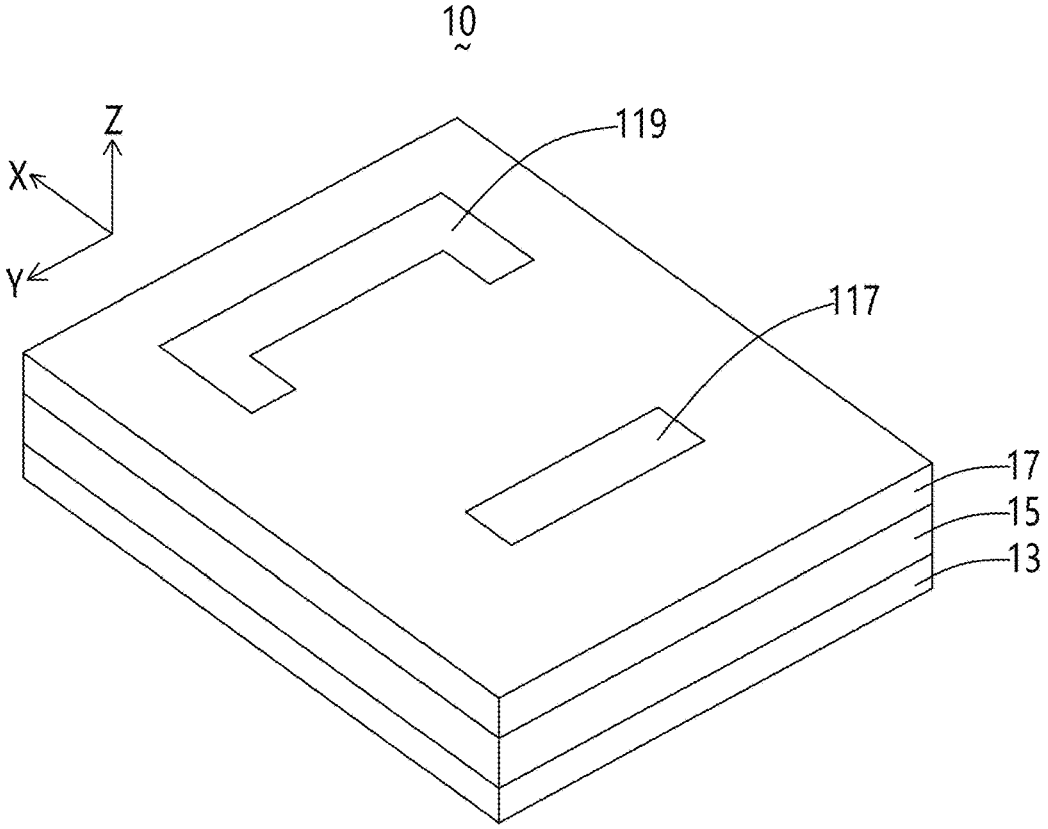
FIG. 2 is a schematic structural diagram of an antenna assembly in the antenna system shown in FIG. 1.
Figure 3:
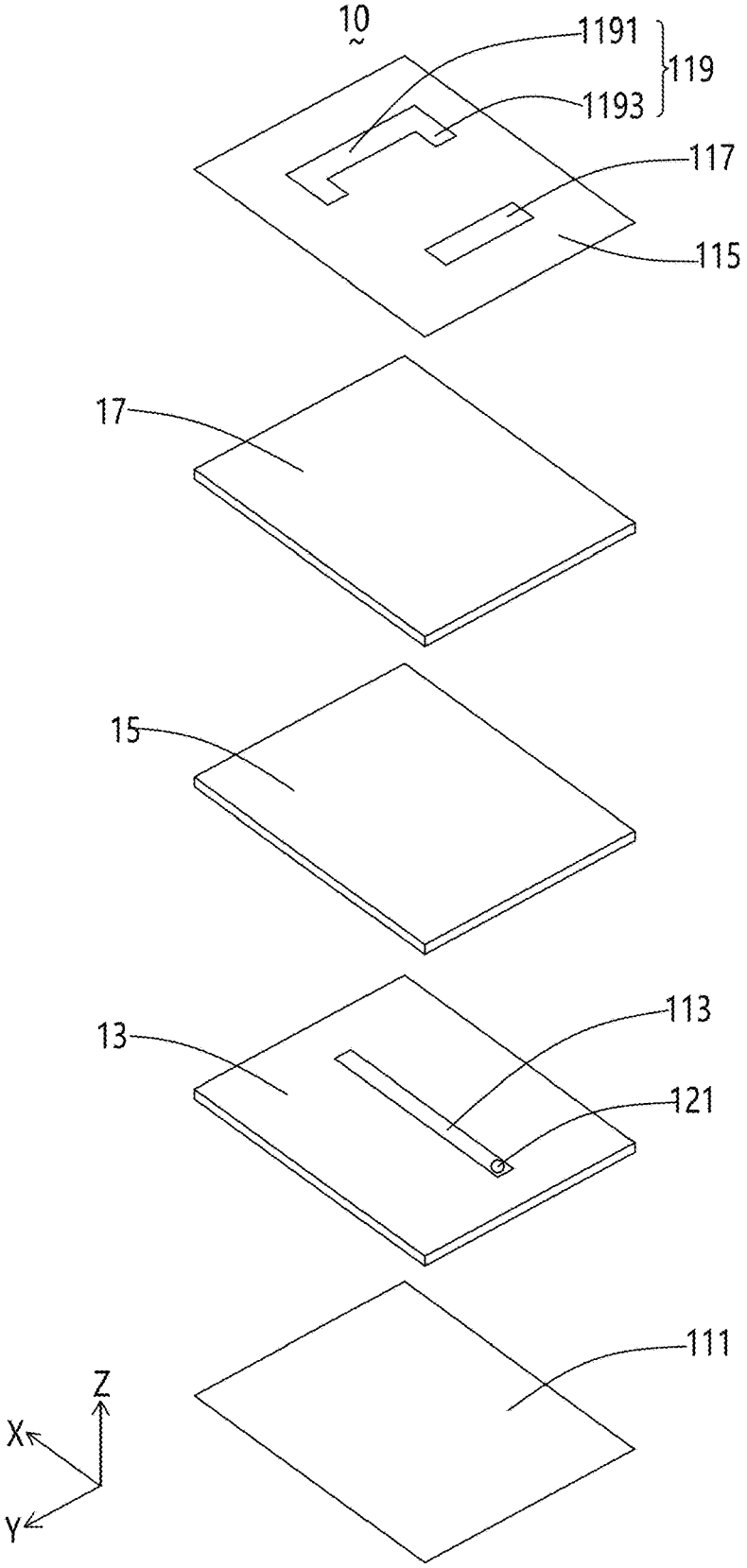
FIG. 3 is an exploded view of the antenna assembly shown in FIG. 2.

As shown in FIGS. 1-3, the present disclosure provides an antenna system 100 in accordance with a first exemplary embodiment. The antenna system 100 comprises a grounding foundation plate 30 and an antenna assembly 10 embedded in the grounding foundation plate 30.

The antenna assembly 10 comprises a first printed circuit board 13, a second printed circuit board 15 and a third printed circuit board 17 stacked in sequence. The second printed circuit board 15 is sandwiched between the first printed circuit board 13 and the third printed circuit board 17.

The antenna assembly 10 further comprises a first conductive layer 111 arranged on one side 15 of the first printed circuit board 13 away from the second printed circuit board 15, a feeding sheet 113 arranged on one side of the first printed circuit board 13 close to the second printed circuit board 15, a second conductive layer 115 arranged on one side of the third printed circuit board 17 far away from the second printed circuit board 15, a first radiation gap 117 and a second radiation gap 119 formed in the second conductive layer 115, wherein the first conductive layer 111 and the second conductive layer 115 are electrically connected with the ground foundation plate 30.

The antenna assembly 10 further comprises a feed point 121 arranged at one end of the feed sheet 113 for being connected with an external power supply, and the energy is coupled to the second conductive layer 115 through the feed sheet 113. A specific current distribution is formed at edges of the first radiation gap 117 and the second radiation gap 119 for stimulating electro-magnetic field.

The first radiation gap 117 operates in a first frequency band. The second radiation gap 119 keeps a distance from the first radiation gap 117, and works in a second frequency band. The first frequency band and the second frequency band are all belong to the frequency bands of 5 G communication. In the embodiment, the first frequency band comprises 37 GHz, and the second frequency band comprises 28 GHz.

In the embodiment, the grounding foundation plate 30 and the antenna assembly 10 are integrally formed. In order to enable the grounding foundation plate to be grounded, a metallized through hole 31 is provided to be electrically connected with the first conductive layer 111 and the second conductive layer 115. Of course, in other embodiments, the grounding foundation plate 30 may be split from the antenna assembly 10, and the grounding foundation plate 30 may also be a solid metal conductor.

In the embodiment, both the first conductive layer 111 and the second conductive layer 115 are metal layers directly printed on the surfaces of the first printed circuit board 13 and the third printed circuit board 17. The first radiation gap 117 and the second radiation gap 119 are formed by etching the first conductive layer 115. The first radiation gap 117 is a rectangular gap. The second radiation gap 119 comprises a first radiation slot 1191 keeping a distance from the first radiation gap 117 and two second radiation slots 1193 extending from two ends of the first radiation slot 1191

Further, the first radiation slot 1191 and the second radiation slots 1193 are rectangular gaps and are communicated with each other.

In this embodiment, the second radiation gap 119 is an axisymmetric gap, and the first radiation gap 117 is symmetric about the symmetry axis of the second radiation gap 119.

In this embodiment, the length of the first radiation slot 1191 is greater than the length of the first radiation gap 117, and the length of the first radiation gap 117 is larger than that of the second radiation slot 1193. The width of the first radiation gap 117 is the same as the width of the second radiation slot 1193; and the width of the first radiation slot 1191.

In this embodiment, the feeding sheet 113 is a rectangular metal strip which is directly printed on the surface of the first printed circuit board 13, and extends along the axis of symmetry of the second radiation gap 119. The orthographic projection of the feed sheet 113 on the third printed circuit board 119 is intersected with the first radiation gap 117 and the second radiation gap 119. The feed point 121 is arranged at a distal end of the feed sheet 113. Optionally, the feed point 121 is arranged at one end close to the first radiation gap 117.

Figure 4:
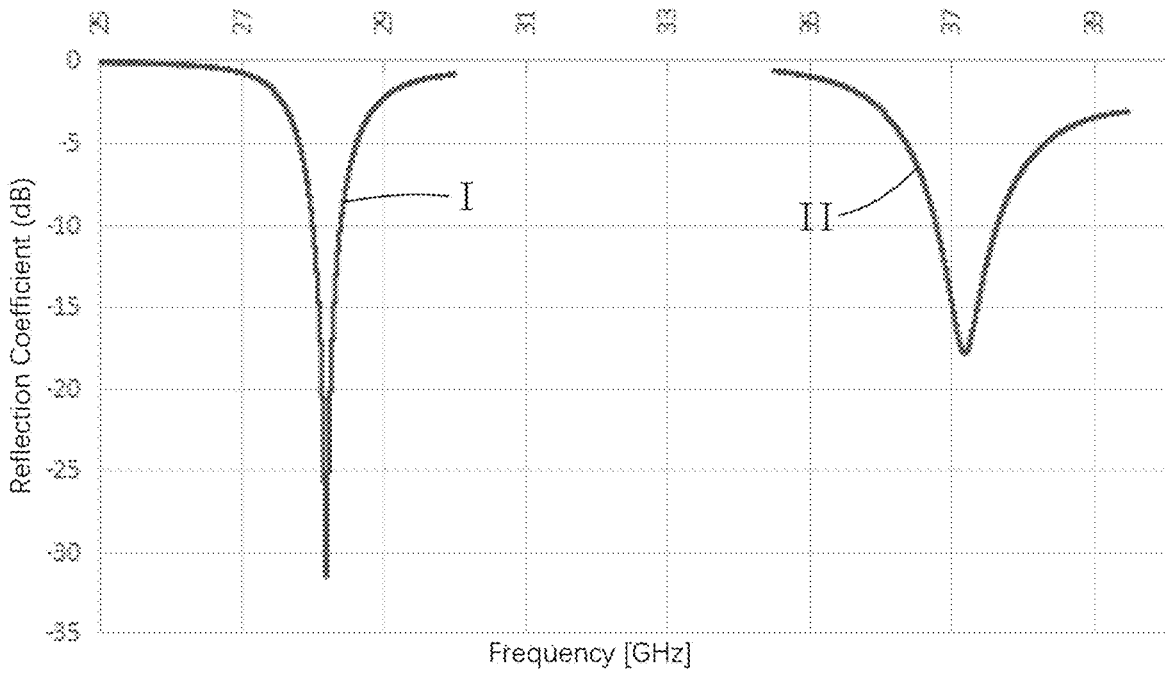
FIG. 4 is a reflection coefficient curve chart of the antenna system shown in FIG. 1.
Figure 5:
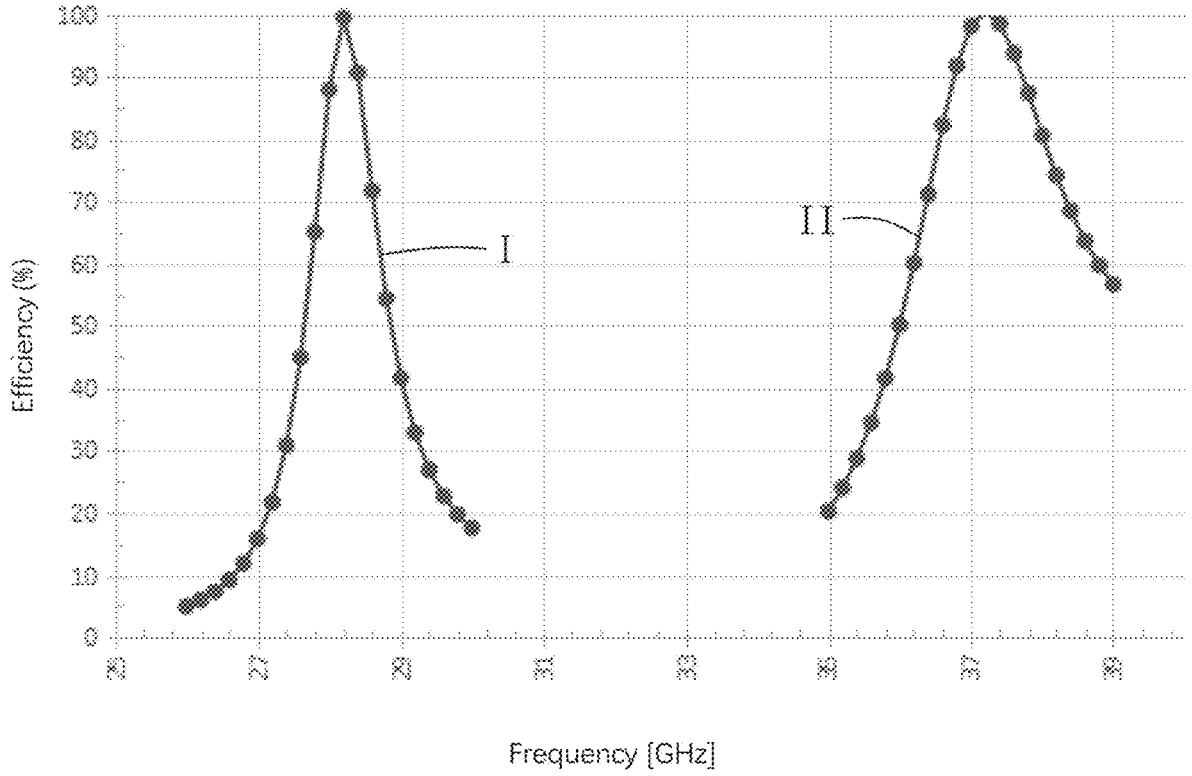
FIG. 5 is a graph of the total efficiency of the antenna system shown in FIG. 1.

FIG. 4 is a graph of reflection coefficient of the antenna system according to the present invention, wherein the I-curve represents a resonance at about 28 GHz stimulation, and the II-curve represents another resonance at about 37 GHz stimulation. As can be seen from FIG. 4, compared with 28 GHz, the antenna system has a wider bandwidth at 37 GHz. Please refer to FIG. 5. FIG. 5 is a graph of the efficiency of the antenna system according to the present invention. It can be seen from FIG. 5, that more than 50% of efficiency improvement in the frequency range of 27.8 GHz-28.8 GHz and 36 GHz-39 GHz is obtained.

Figure 6:
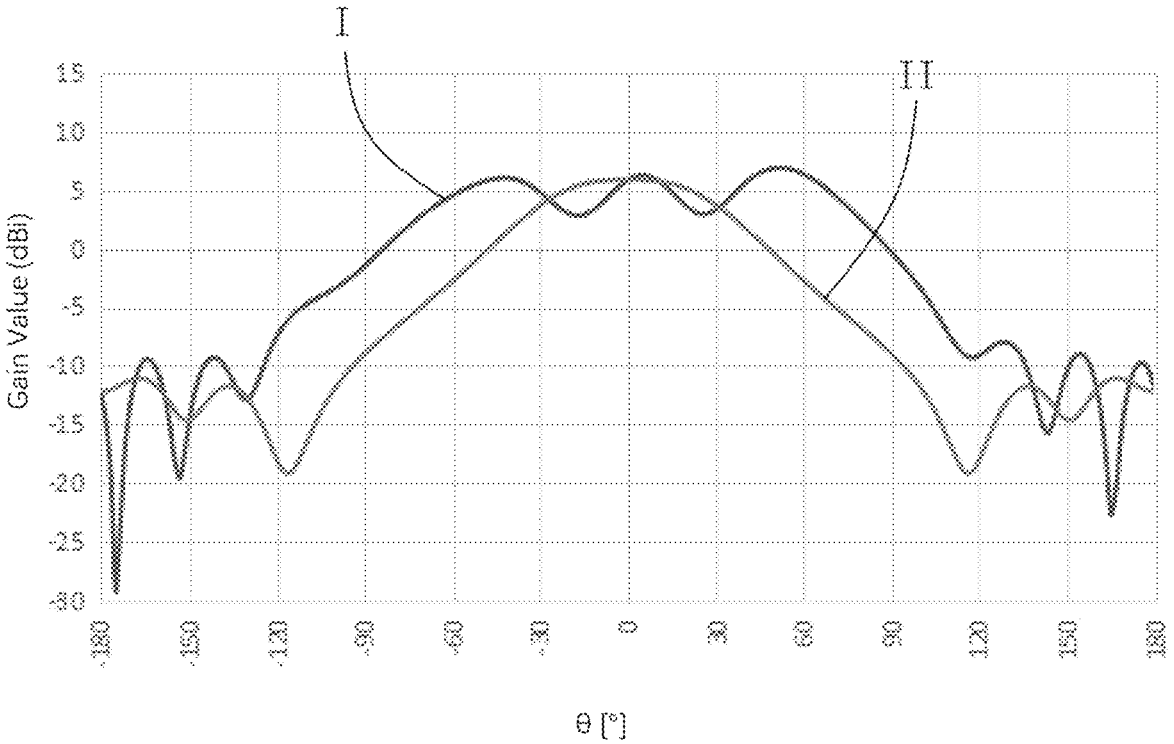
FIG. 6 is a gain curve of the antenna system shown in FIG. 1, at 28 GHz frequency band and a rectangular coordinate system.
Figure 7:
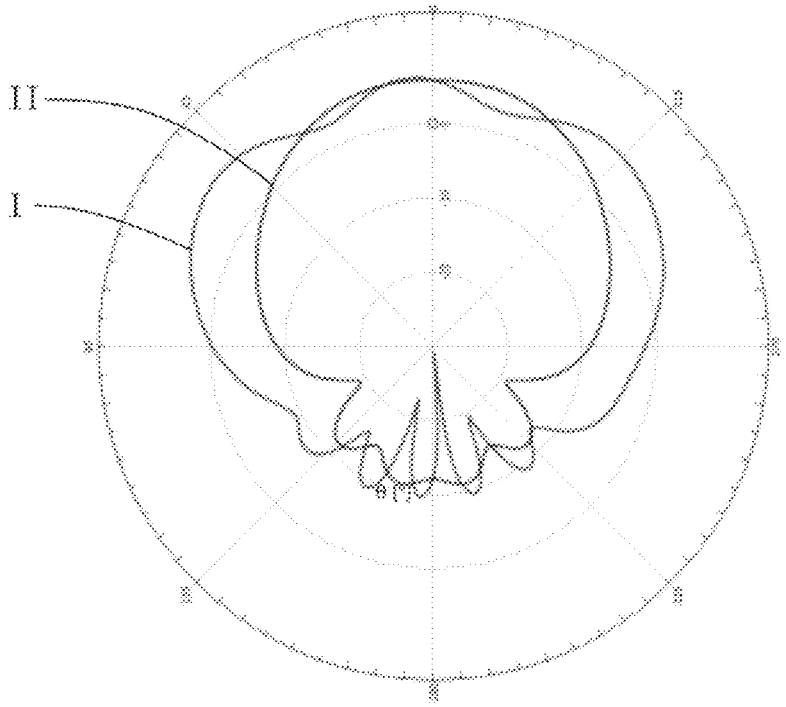
FIG. 7 is a gain curve of the antenna system shown in FIG. 1 at 28 GHz frequency band and a polar coordinate system.

Gain of antenna system at 28 GHz is shown in FIG. 6 and FIG. 7, FIG. 6 and FIG. 7 show the plane phi=0 degree (XZ plane) and phi=90 degrees (yz plane)), wherein the I-curve represents a gain curve on the plane phi=0 degree, wherein the II-curve represents a gain curve of the plane phi=90 degrees.

Figure 8:
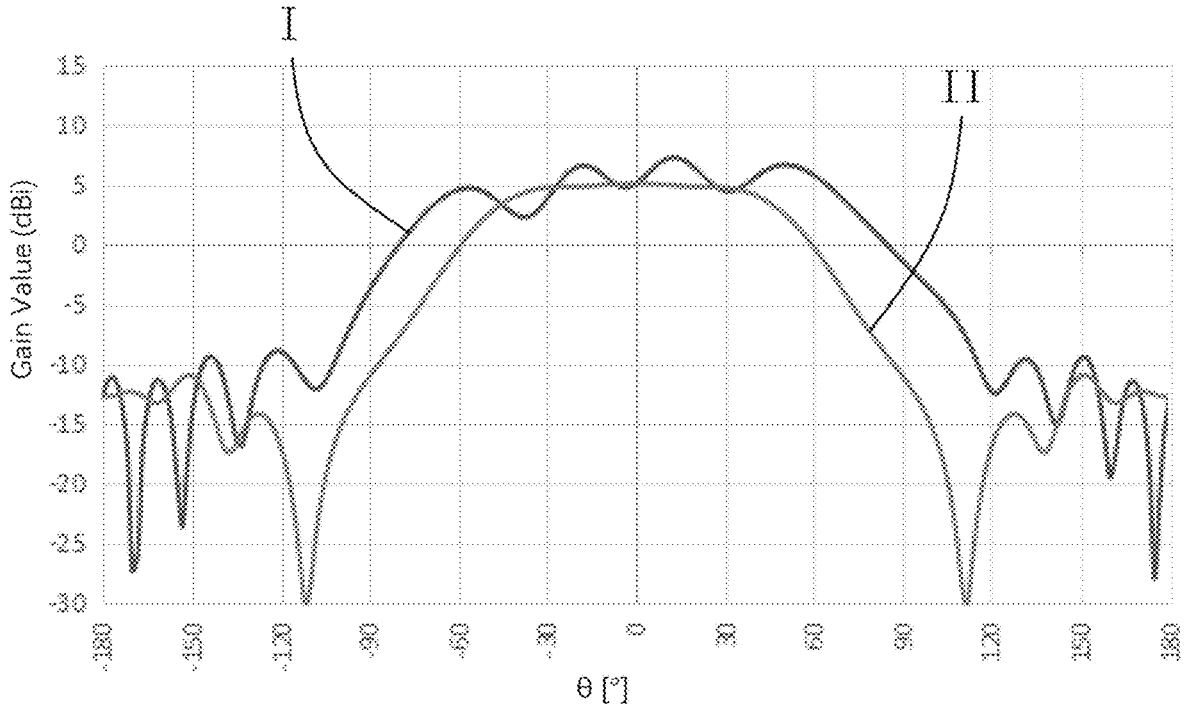
FIG. 8 is a gain curve of the antenna system shown in FIG. 1 at 37 GHz frequency band and a rectangular coordinate system.
Figure 9:
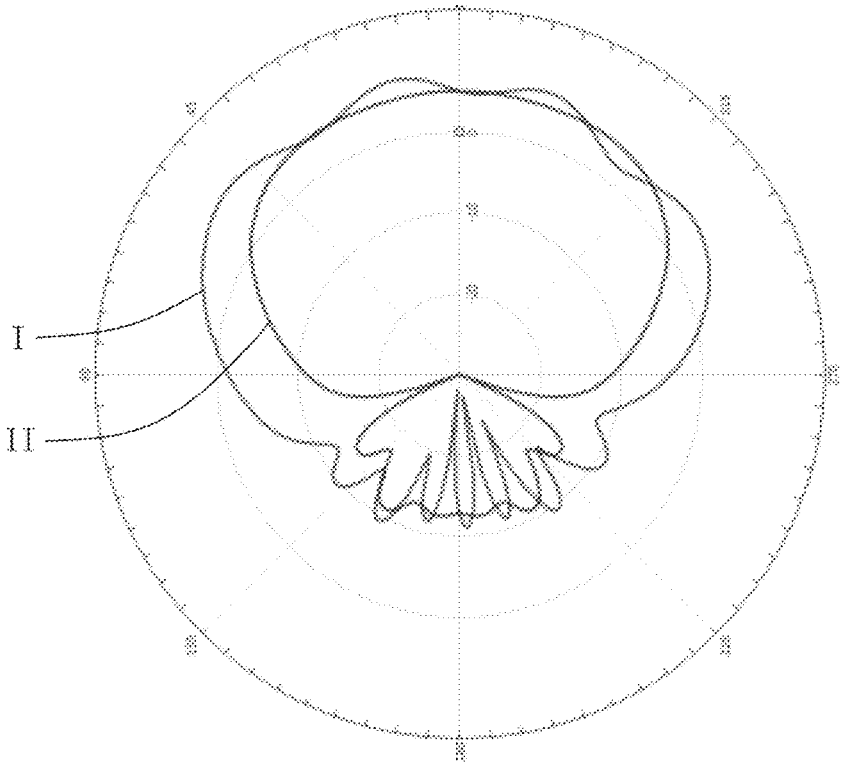
FIG. 9 is a gain curve of the antenna system shown in FIG. 1 at 37 GHz frequency band and a polar coordinate system.

Gain of antenna system at 37 GHz refer to FIG. 8 and FIG. 9, FIG. 8 and FIG. 9 show the plane phi=0 degree (XZ plane) and phi=90 degrees (yz plane)), wherein the I-curve represents a gain curve on the plane phi=0 degree, wherein the II-curve represents a gain curve of the plane phi=90 degrees.

The invention further provides a mobile terminal. The mobile terminal comprises the antenna system described above.

Compared with the prior art, the antenna system 100 provided by the invention is a dual-waveband millimeter wave antenna. A first radiation gap 117 is used for generating a first frequency band and a second radiation gap 119 is used for generating a second frequency band. The antenna system 100 can cover 37 GHz and 28 GHz frequency bands.

Second Embodiment

Figure 10:
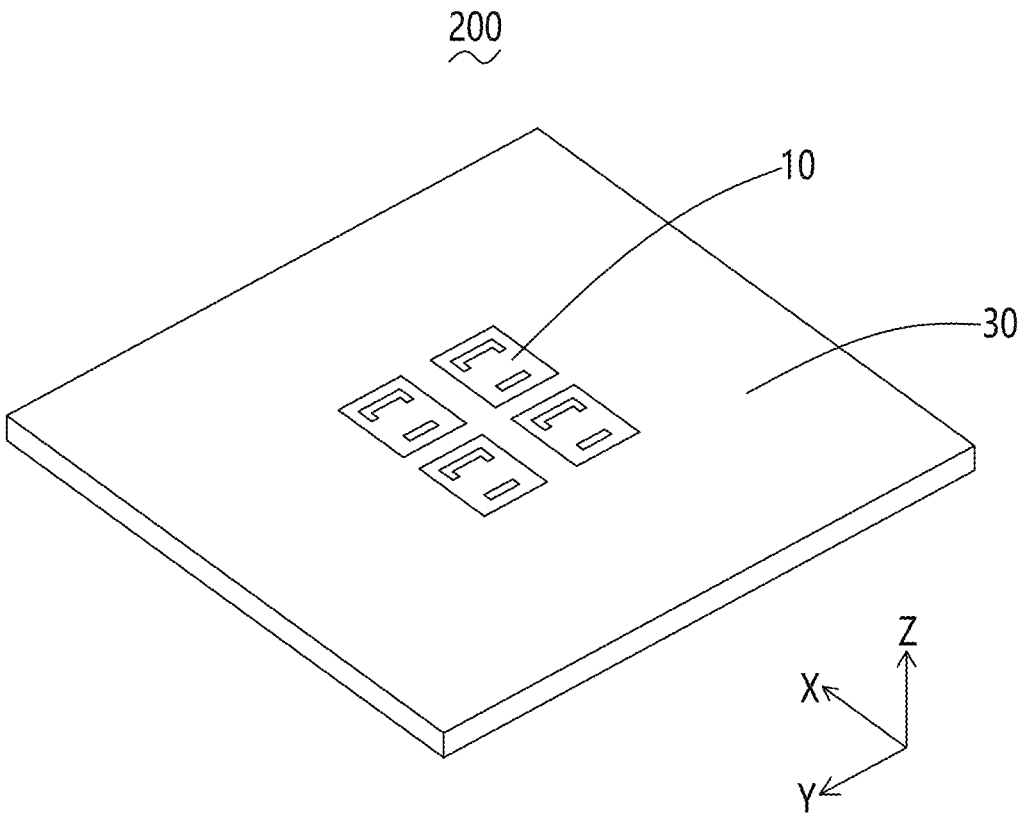
FIG. 10 is a schematic structural diagram of a phased array antenna system in accordance with a second embodiment of the present disclosure.

Referring to FIG. 10, in this embodiment, the antenna system 200 provided by the present invention is a phased array antenna system, which comprises four antenna assemblies 10 as described in the first embodiment. The four antenna assemblies 10 are symmetrically arranged in a plane matrix and are arranged in the center of the grounding foundation plate. In the phased array arrangement, the array antenna can perform beam scanning on any phi plane at different theta angles. Almost Omni-Directional radiation can be achieved. Of course, it should be noted that in other embodiments, the antenna system can include more antenna components to form a larger phased array.

Figure 11:
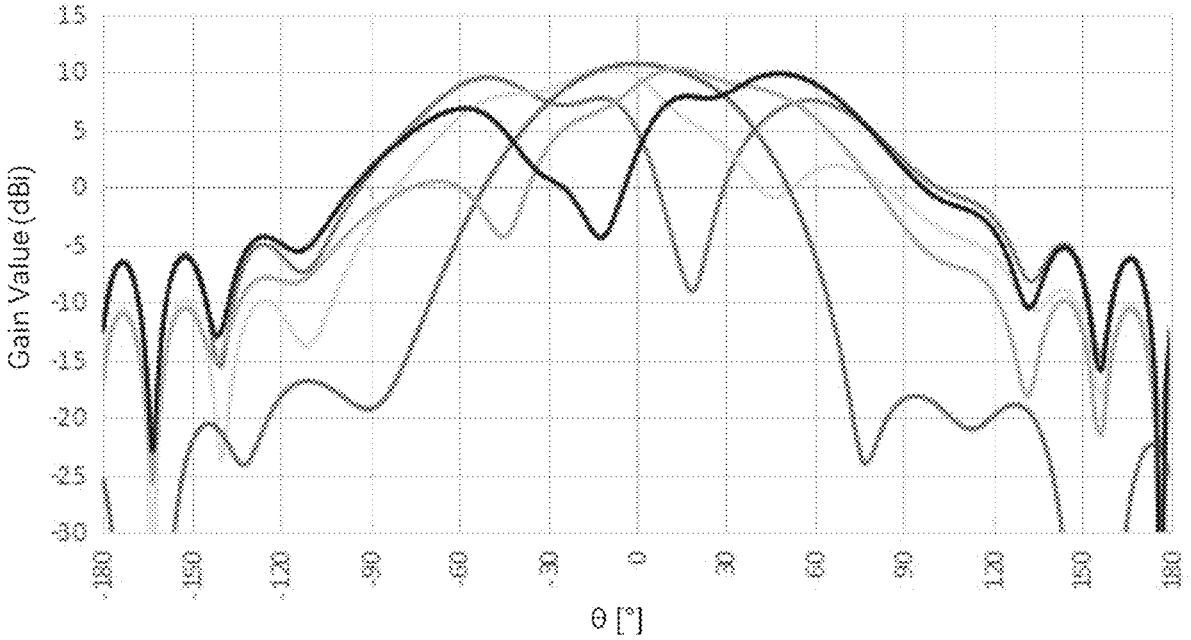
FIG. 11 is a diagram of the phased array antenna system of FIG. 10 at 28 GHz frequency band, wherein the plane phi is equal to 0 degrees, and a gain curve in the rectangular coordinate system is obtained.
Figure 12:
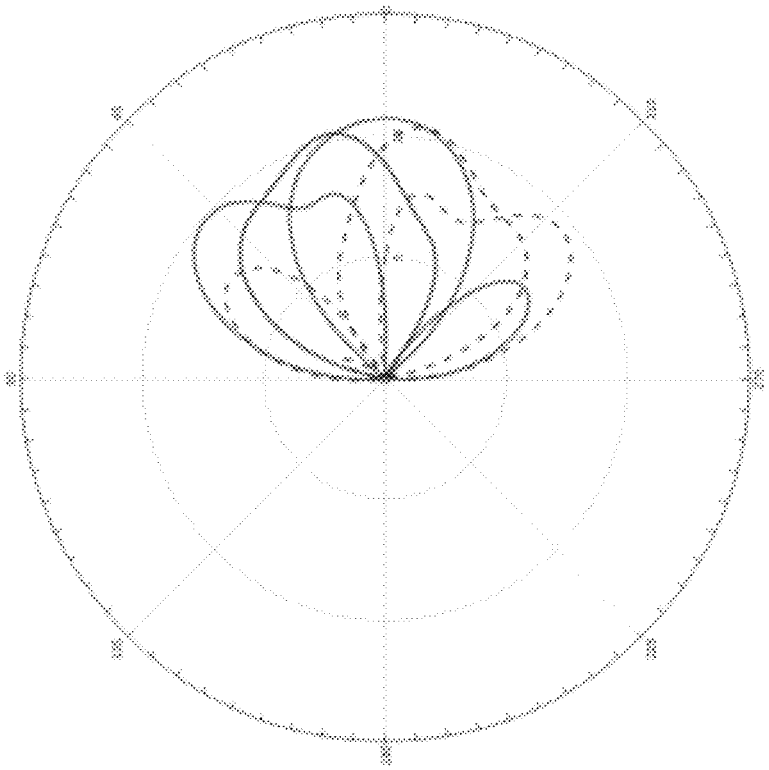
FIG. 12 is a diagram of the phased array antenna system of FIG. 10 at 28 GHz frequency band, wherein the plane phi is equal to 0 degrees, and a gain curve in the polar coordinate system is obtained.
Figure 13:
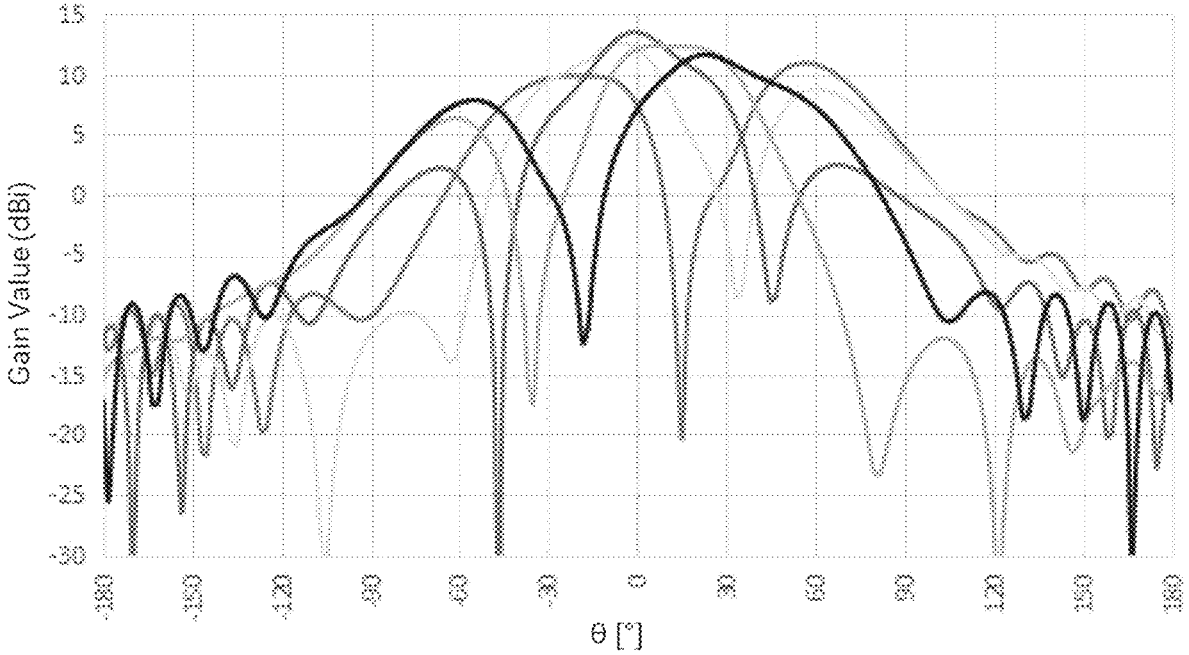
FIG. 13 is a diagram of the phased array antenna system of FIG. 10 at 37 GHz frequency band, wherein the plane phi is equal to 0 degrees, and a gain curve in the rectangular coordinate system is obtained.
Figure 14:
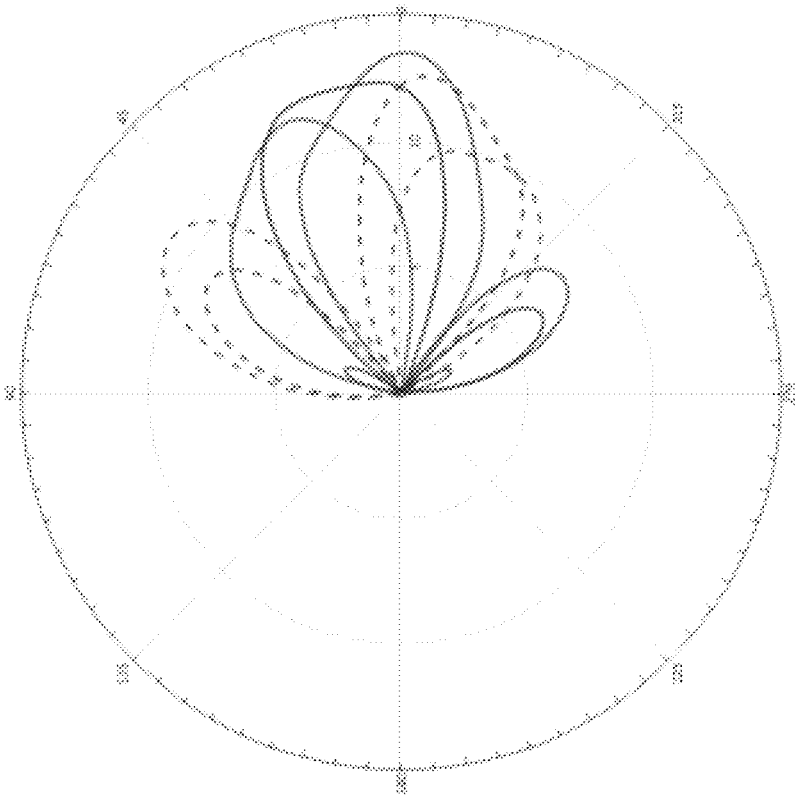
FIG. 14 is a diagram of the phased array antenna system of FIG. 10 at 37 GHz frequency band, wherein the plane phi is equal to 0 degrees, and a gain curve in the polar coordinate system is obtained.

Referring to FIGS. 11 and 12, it can be seen from FIG. 11 and FIG. 12, in a 28 GHz frequency band and a Phi=0 degree plane, and the scanning angle theta angle of the main beam ranges from −68.3 degrees to 70 degrees, and the gain is kept above 7 dBi. Please refer to FIG. 13 and FIG. 14, and can be seen from FIG. 13 and FIG. 14, in the plane of the 37 GHz frequency band and the Phi=0 degree, and the scanning angle theta angle of the main beam ranges from −65 degrees to 80 degrees, and the gain is kept above 7 dBi.

Figure 15:
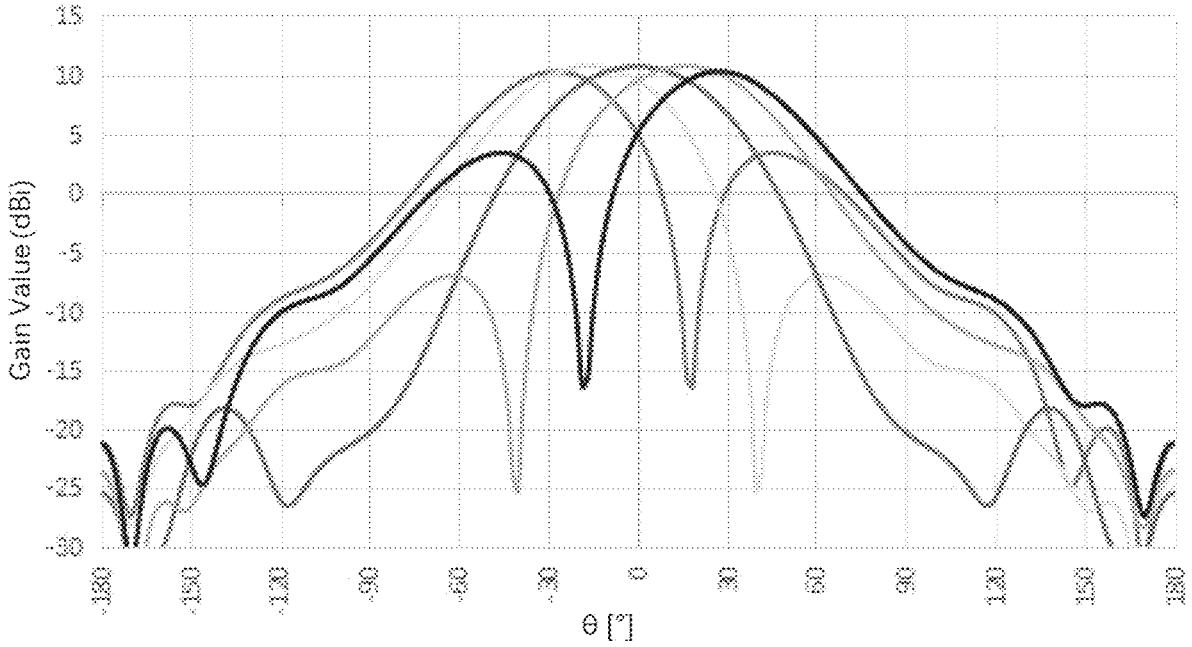
FIG. 15 is a diagram of the phased array antenna system of FIG. 10 at 28 GHz frequency band, wherein the plane phi is equal to 90 degrees, and a gain curve in the rectangular coordinate system is obtained.
Figure 16:
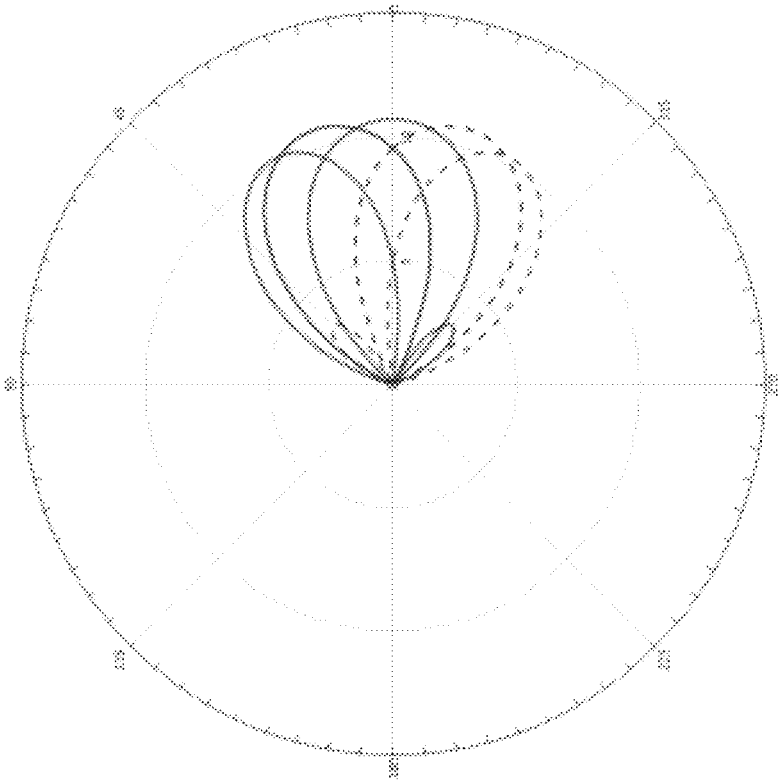
FIG. 16 is a diagram of the phased array antenna system of FIG. 10 at 28 GHz frequency band, wherein the plane phi is equal to 90 degrees, and a gain curve in the polar coordinate system is obtained.
Figure 17:
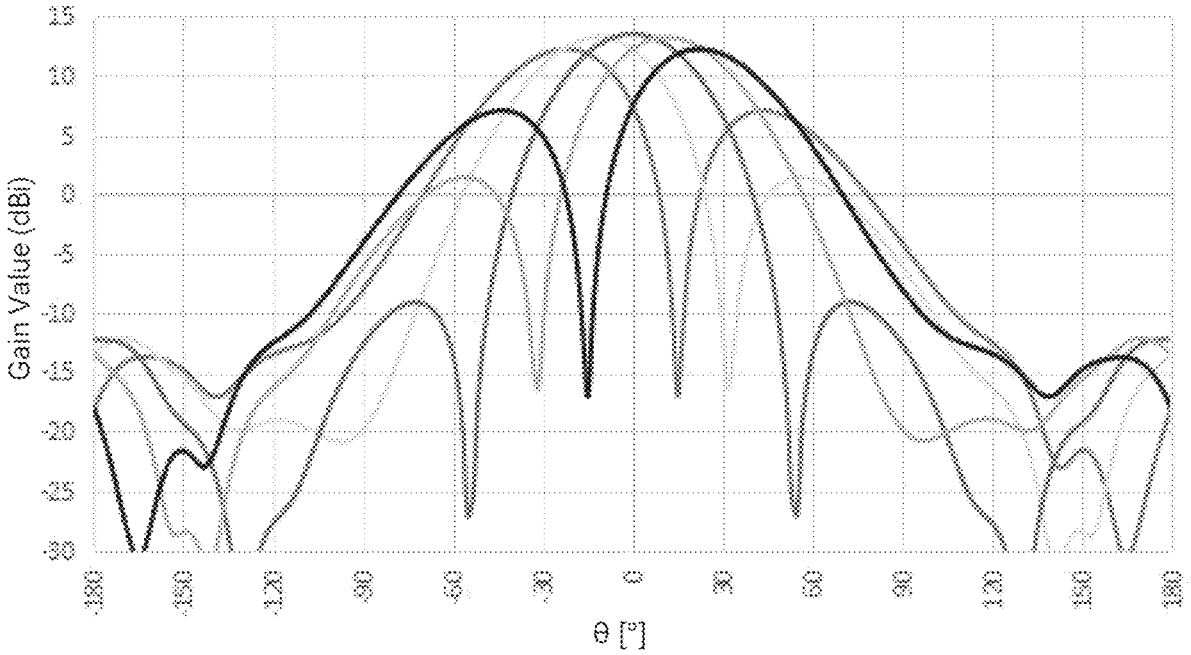
FIG. 17 is a diagram of the phased array antenna system of FIG. 10 at 37 GHz frequency band, wherein the plane phi is equal to 90 degrees, and a gain curve in the rectangular coordinate system is obtained.
Figure 18:
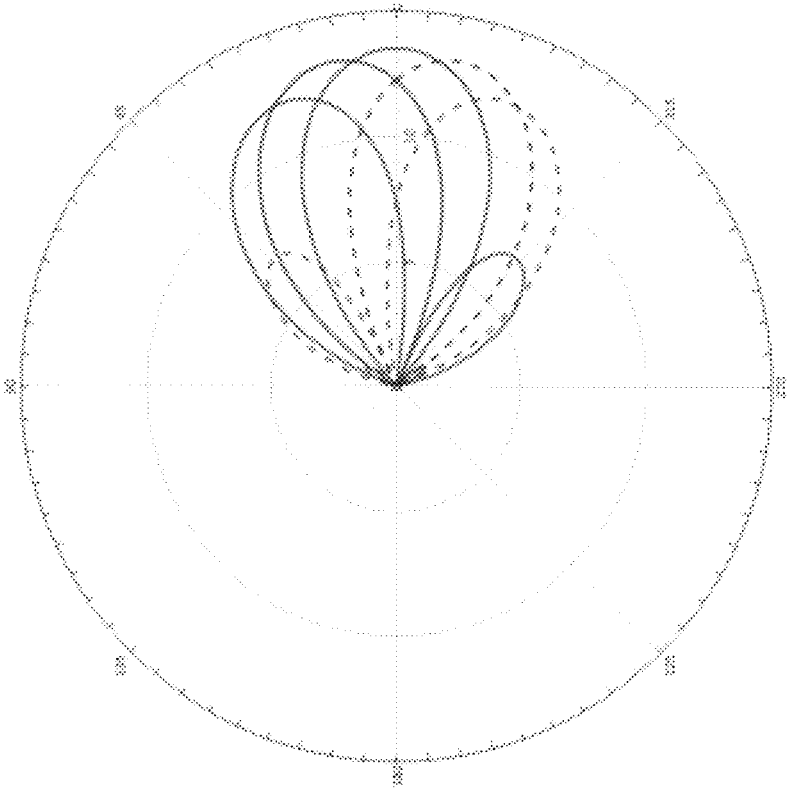
FIG. 18 is a diagram of the phased array antenna system of FIG. 10 under 37 GHz frequency band, wherein the plane phi is equal to 90 degrees, and a gain curve in the polar coordinate system is obtained.

Referring to FIGS. 15 and 16, it can be seen from FIGS. 15 and 16, in a 28 GHz frequency band, the Phi is equal to a 90-degree plane, and the scanning angle theta angle of the main beam ranges from −51.7 degrees to 51.7 degrees, and the gain is kept above 7 dBi. Rrefer to FIGS. 17 and 18, and can be seen from FIGS. 17 and 18, in the plane of 37 GHz, Phi is equal to 90 degrees, and the scanning angle theta angle of the main beam ranges from −51.7 degrees to 51.7 degrees, and the gain is kept above 7 dBi.

Figure 19:
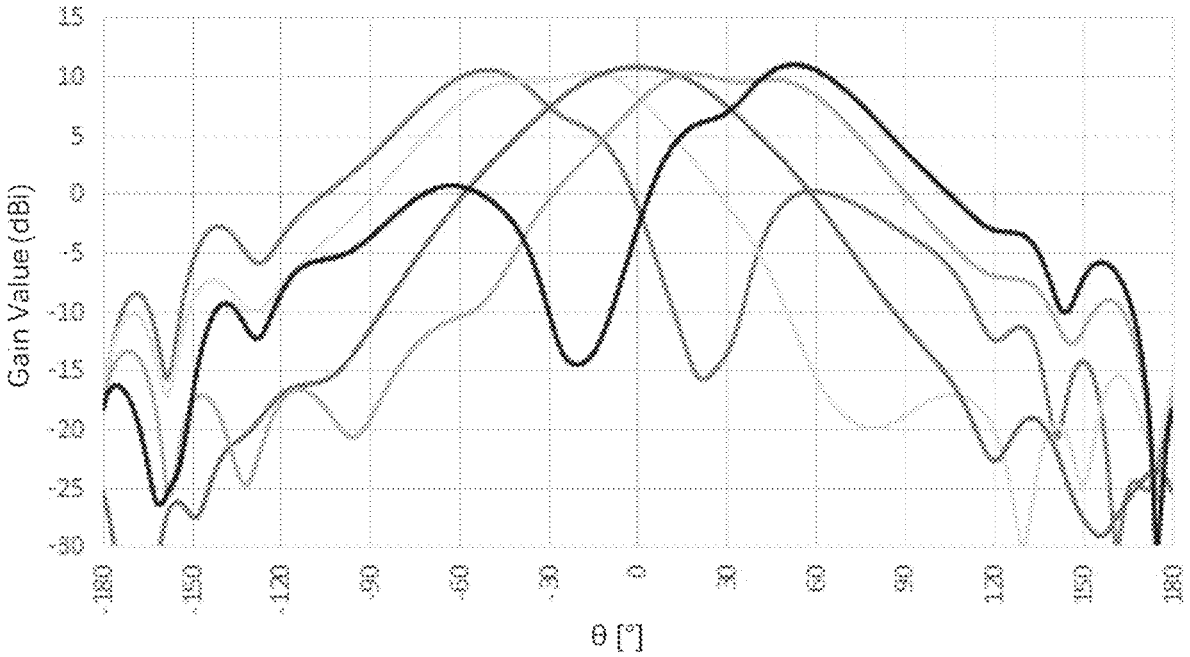
FIG. 19 is a diagram of the phased array antenna system of FIG. 10 at 28 GHz frequency band, wherein the plane phi is equal to 45 degrees, and a gain curve in the rectangular coordinate system is obtained.
Figure 20:
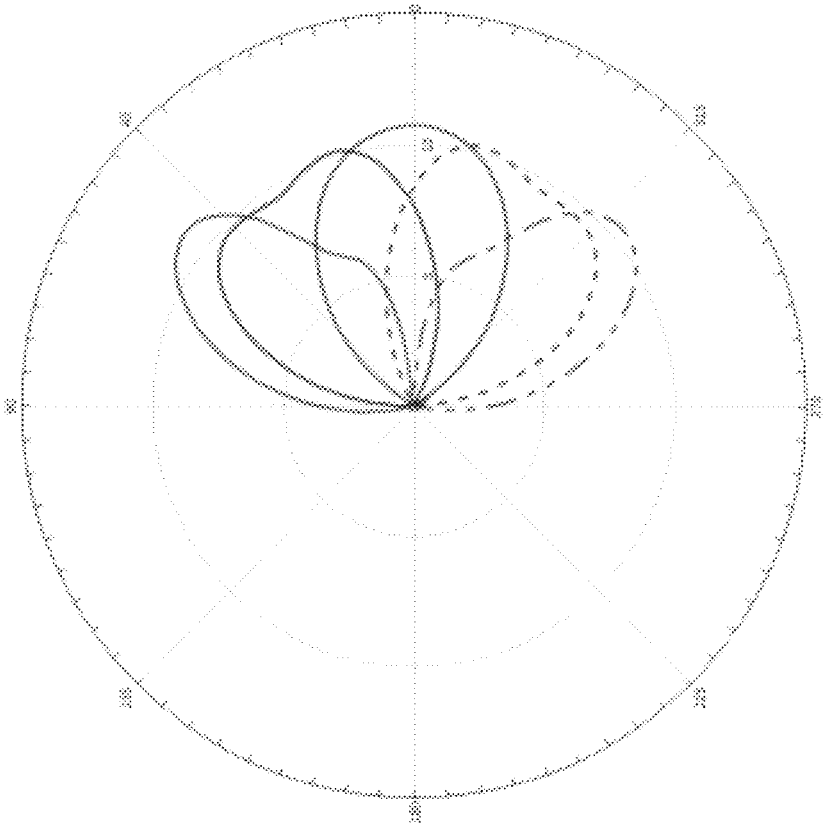
FIG. 20 is a diagram of the phased array antenna system of FIG. 10 under 28 GHz frequency band, wherein the plane phi is equal to 45 degrees, and a gain curve in the polar coordinate system is obtained.
Figure 21:
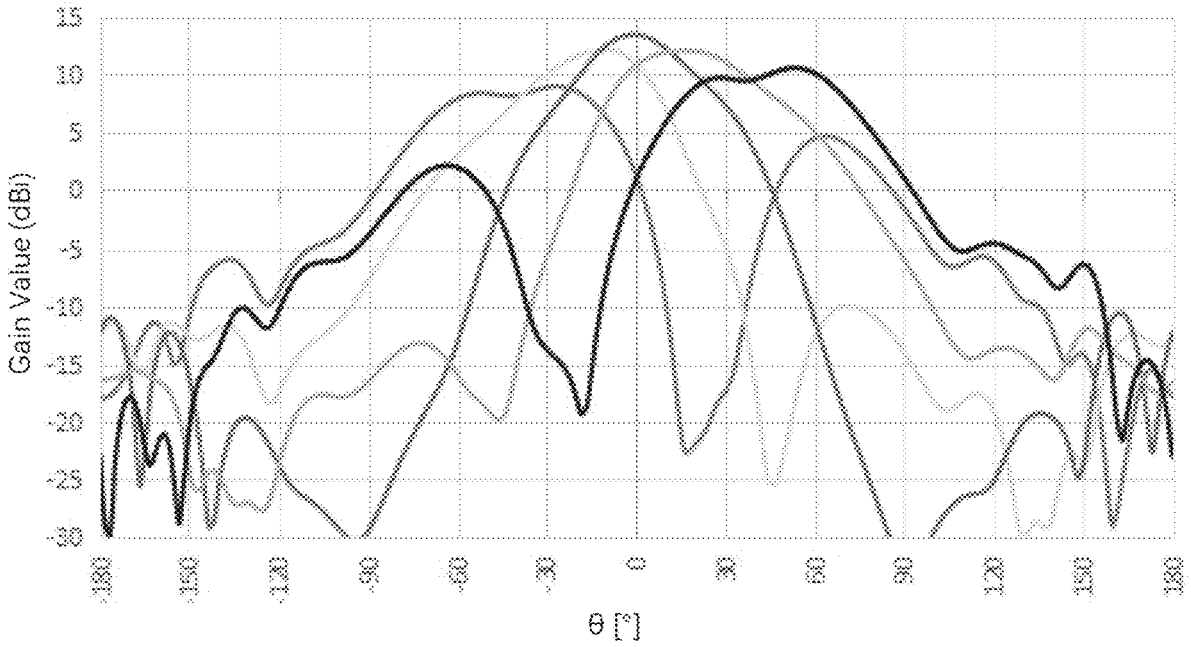
FIG. 21 is a diagram of the phased array antenna system of FIG. 10 at 37 GHz frequency band, wherein the plane phi is equal to 45 degrees, and a gain curve in the rectangular coordinate system is obtained.
Figure 22:
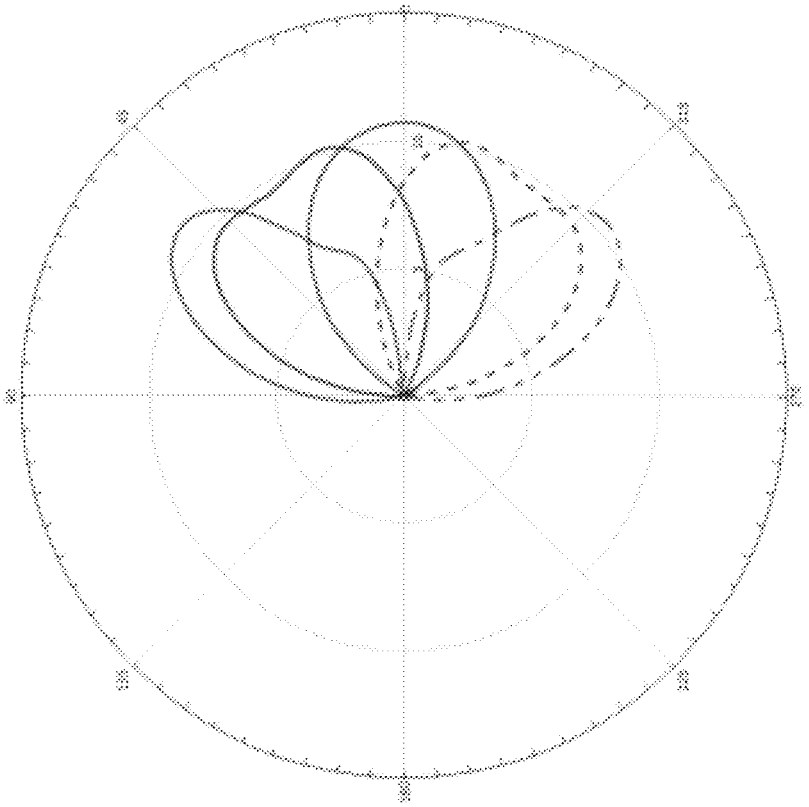
FIG. 22 is a diagram of the phased array antenna system of FIG. 10 at 37 GHz frequency band, wherein the plane phi is equal to 45 degrees, and a gain curve in the polar coordinate system is obtained.

Referring to FIGS. 19 and 20, it can be seen from FIGS. 19 and 20, in a 28 GHz frequency band, and the Phi is equal to a 45-degree plane, and the scanning angle theta angle of the main beam ranges from −73.3 degrees to 76.7 degrees, and the gain is kept above 7 dBi. Rreferring to FIGS. 21 and 22, it can be seen from FIG. 21 and FIG. 22, in the plane of 37 GHz, Phi is equal to 45 degrees, and the scanning angle theta angle of the main beam ranges from −65 degrees to 73.3 degrees, and the gain is kept above 7 dBi.

Figure 23:
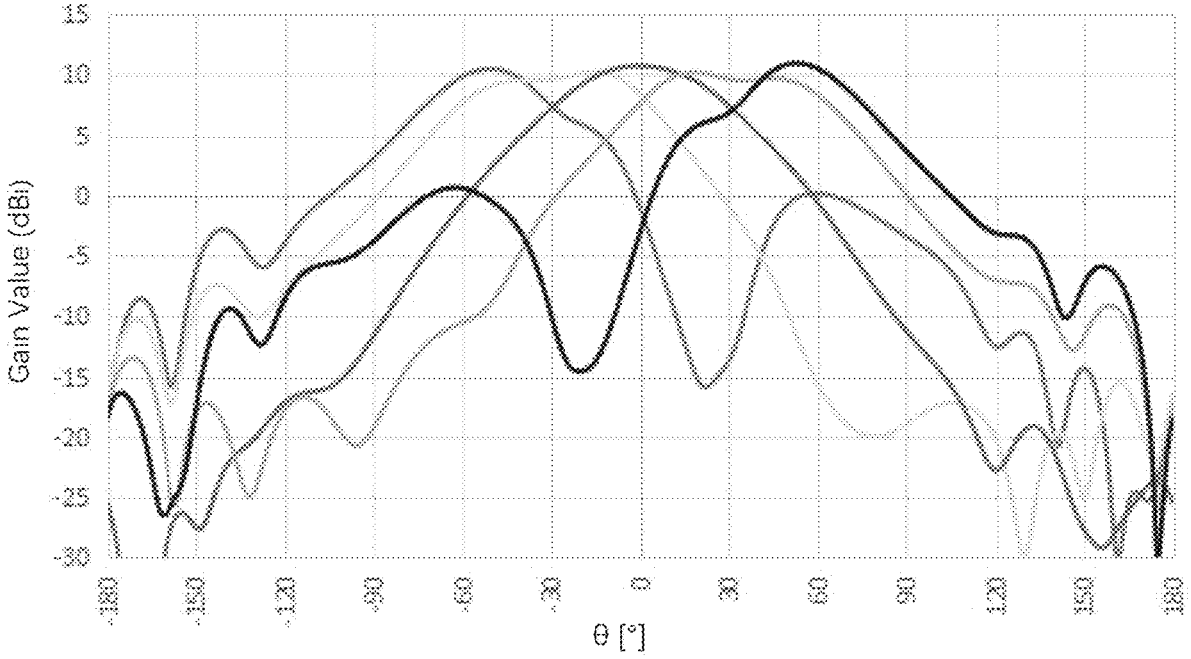
FIG. 23 is a diagram of the phased array antenna system of FIG. 10 at 28 GHz frequency band, wherein the plane phi is equal to 315 degrees, and a gain curve in the rectangular coordinate system is obtained.
Figure 24:
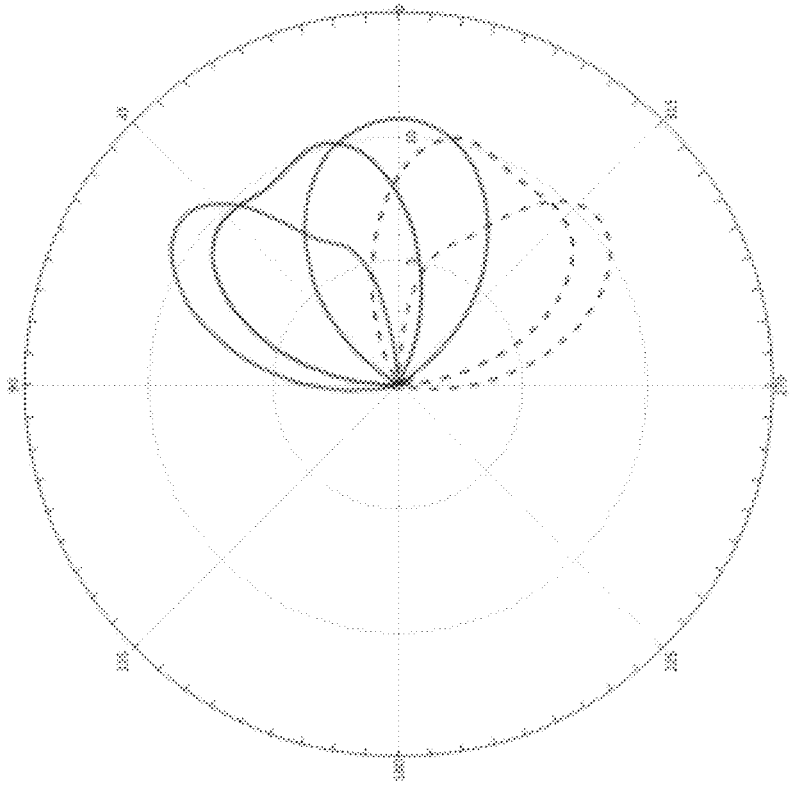
FIG. 24 is a diagram of the phased array antenna system of FIG. 10 at 28 GHz frequency band, wherein the plane phi is equal to 315 degrees, and a gain curve in the polar coordinate system is obtained.
Figure 25:
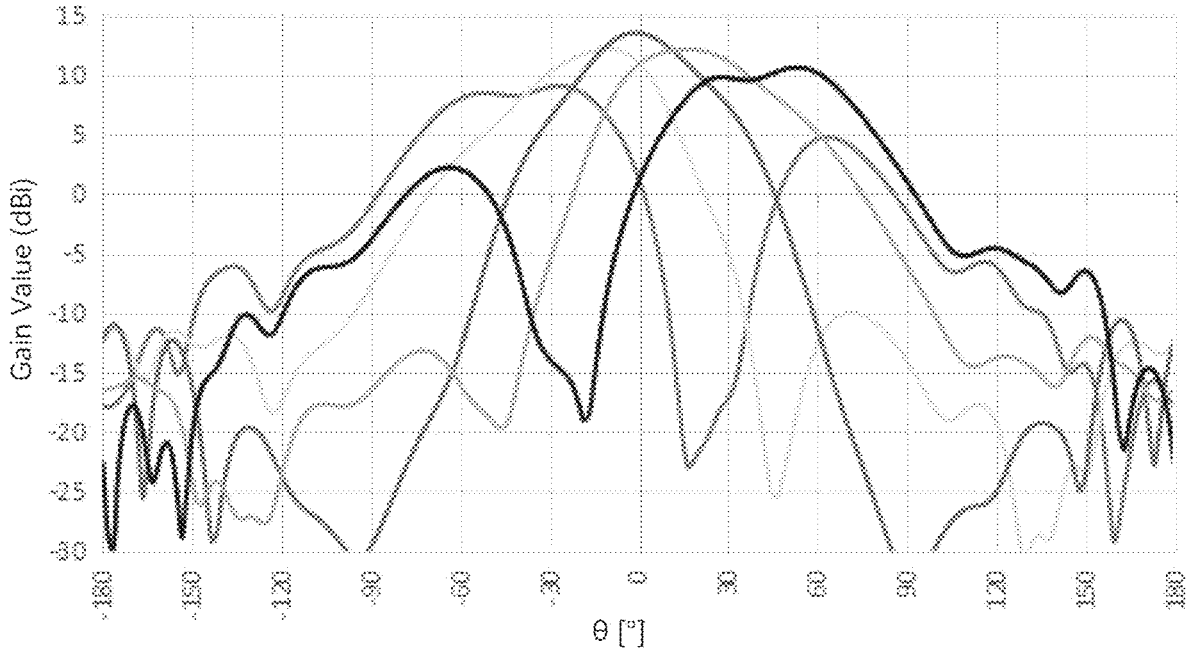
FIG. 25 is a diagram of the phased array antenna system of FIG. 10 at 37 GHz frequency band, wherein the plane phi is equal to 315 degrees, and a gain curve in the rectangular coordinate system is obtained.
Figure 26:
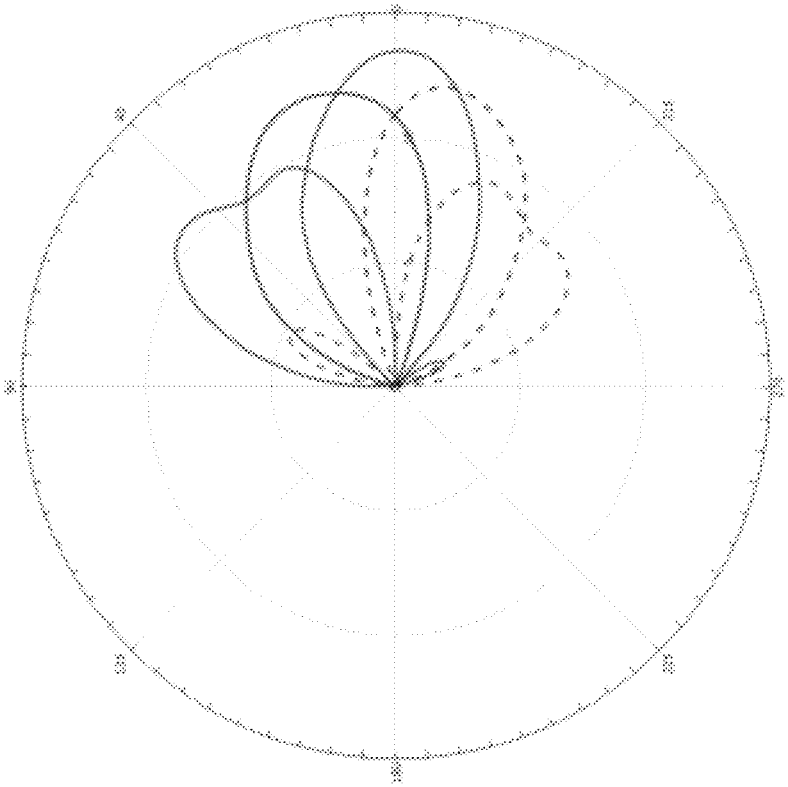
FIG. 26 is a diagram of the phased array antenna system of FIG. 10 at 37 GHz frequency band, wherein the plane phi is equal to 315 degrees, and a gain curve in the polar coordinate system is obtained.

Referring to FIGS. 23 and 24, it can be seen from FIGS. 23 and 24, in the plane of 28 GHz, and the Phi is equal to 315 degrees, and the scanning angle theta angle of the main beam ranges from −73.3 degrees to 76.7 degrees, and the gain is kept above 7 dBi. Rreferring to FIGS. 25 and 26, it can be seen from FIG. 25 and FIG. 26, in the plane of the 37 GHz frequency band and the Phi=315 degrees, and the scanning angle theta angle of the main beam ranges from −65 degrees to 73.3 degrees, and the gain is kept above 7 dBi.

Figure 27:
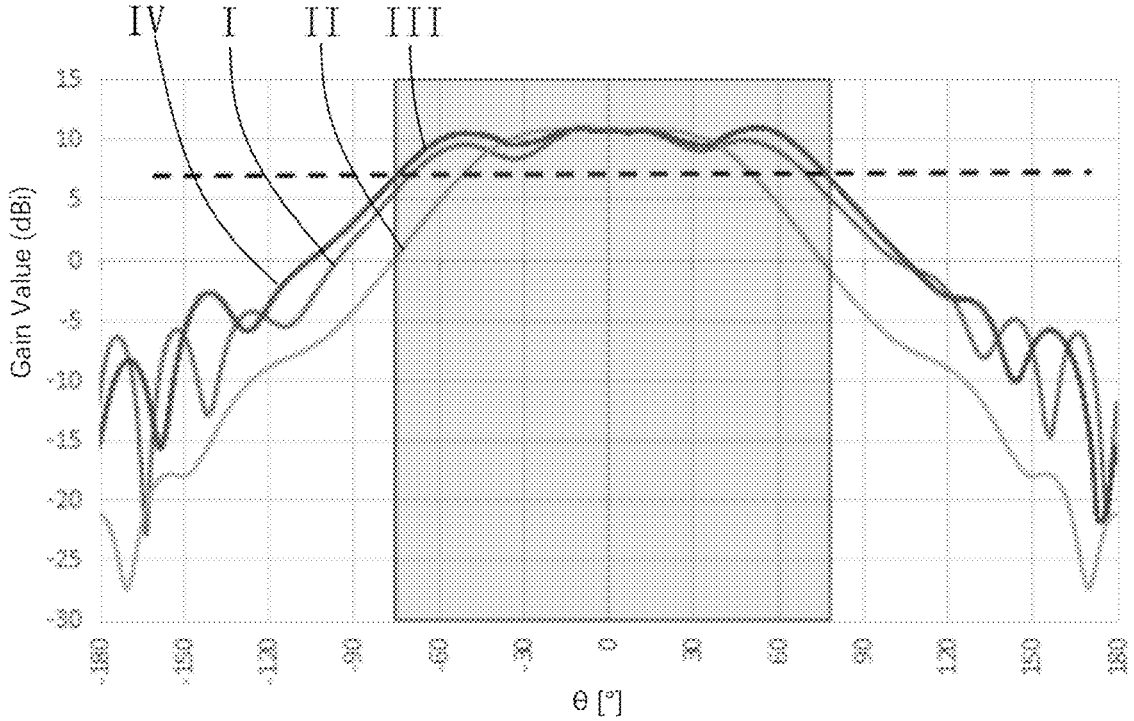
FIG. 27 is a diagram of the gain curves of the phased array antenna system shown in FIG. 10 at 28 GHz frequency band, wherein the planes phi are equal to 0 degrees, 90 degrees, 45 degrees, and 315 degrees.

Referring to FIG. 27, FIG. 27 is a diagram of a phased array antenna system of FIG. 10 in a 28 GHz frequency band, wherein the phi is equal to 0 degree, phi=90 degrees, phi=45 degrees and phi=315 degrees, wherein, the I-curve represents a gain curve on the plane of the phi=0 degree, and the II-curve represents a gain curve on the plane with the phi=90 degrees, and the III-curve represents a gain curve on the plane of the phi=45 degrees, wherein the IV-curve represents a gain curve on the plane of the phi=315 degrees; the III-curve and the IV-curve are almost overlapped. As can be seen from FIG. 27, in a 28 GHz frequency band, the phased array antenna system is on any PHI plane, and the gain of the antenna can be kept above 7 dBi within a scanning angle range of more than 100 degrees, so that the phased-array antenna system has Omni-Directional performance. Meanwhile, through comparison, it can be seen that the antenna system has a plane phi=45 degrees. And a padder wherein the plane phi is larger than 315 degrees and has a larger scanning angle.

Figure 28:
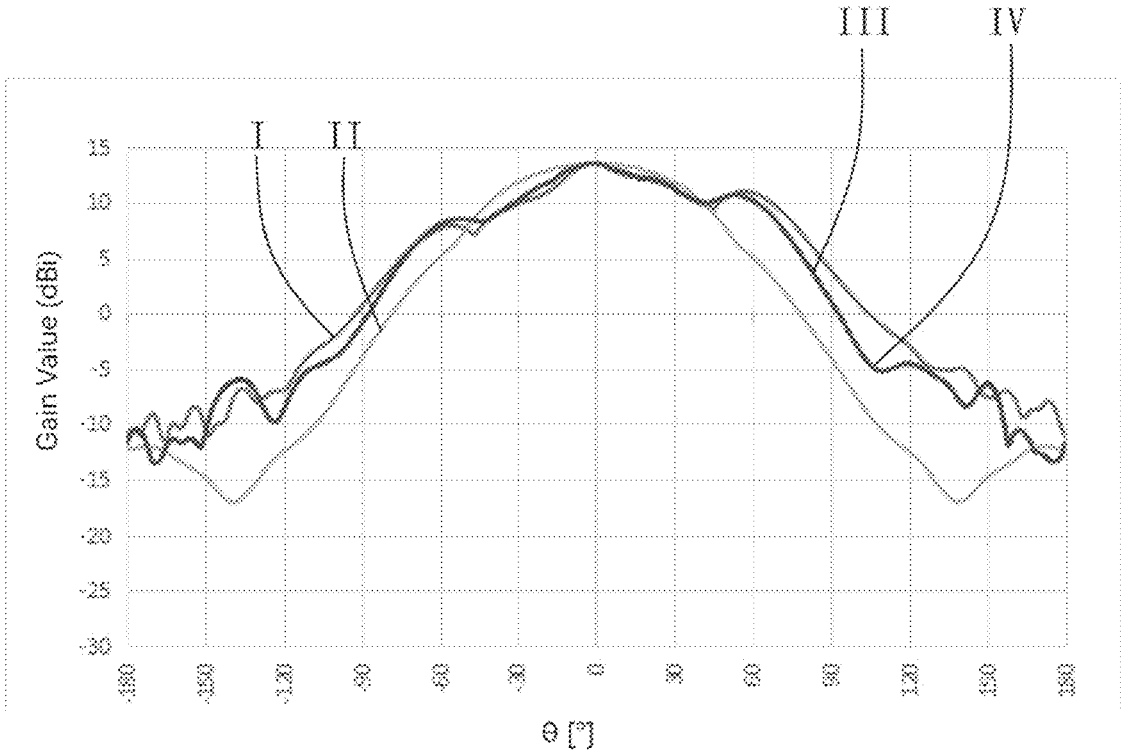
FIG. 28 is a diagram of the gain curves of the phased array antenna system shown in FIG. 10 at 37 GHz frequency band, wherein the plane phi are 0 degrees, 90 degrees, degrees and 315 degrees.

Referring to FIG. 28, FIG. 28 is a diagram of a phased array antenna system of FIG. 10 in a 37 GHz frequency band, wherein the phi is equal to 0 degree, phi=90 degrees, phi=45 degrees and phi=315 degrees, wherein, the i line represents a gain curve on the plane of the phi=0 degree, and the II-curve represents a gain curve on the plane with the phi=90 degrees, and the III-curve represents a gain curve on the plane of the phi=45 degrees, wherein the IV-curve represents a gain curve on the plane of the phi=315 degrees; the III-curve and the IV-curve are almost overlapped. As can be seen from FIG. 28, in a 37 GHz frequency band, the phased array antenna system is on any PHI plane, and the gain of the antenna can be kept above 7 dBi at a scanning angle of more than 100 degrees, so that the phased-array antenna system has omni-directional performance. Meanwhile, through comparison, it can be seen that the antenna system has a larger scanning angle in the plane phi=0 degree.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An antenna system including:

A grounding foundation plate;

an antenna assembly embedded in the grounding foundation plate, comprising a first printed circuit board, a second printed circuit board, a third printed circuit board which are stacked in sequence;

a first conductive layer arranged on one side of the first printed circuit board far away from the second printed circuit board;

a feed sheet arranged on a side of the first printed circuit board close to the second printed circuit board;

a second conductive layer arranged on one side of the third printed circuit board away from the second printed circuit board;

a first radiation gap disposed in the second conductive layer;

a second radiation gap disposed in the second conductive layer;

the first and second conductive layers respectively electrically connecting to the grounding foundation plate;

a feed point disposed at one end of the feed sheet for electrically connecting to an external circuit and transferring the power to the second conductive layer via the feed sheet, by which, the first radiation gap works at a first frequency band, and the second radiation gap works at a second frequency band; both of the first and second frequency bands being included in 5 G frequency bands;

the first radiation gap and the second radiation gap are both axisymmetric gaps, and the first radiation gap is symmetric about a symmetry axis of the second radiation gap;

the first radiation gap is a rectangular gap, wherein the second radiation gap comprises a first radiation slot arranged in parallel with the first radiation gap and two second radiation slots vertically extending from two ends of the first radiation slot, the first radiation slot and the second radiation slots are rectangular gaps and are communicated with each other.

2. The antenna system as described in claim 1, wherein, the feed sheet is a rectangular metal sheet extending in the extension direction of the symmetry axis of the second radiation gap, the orthographic projection of the feeding sheet on the third printed circuit board is intersected with the first radiation gap and the second radiation gap.

3. The antenna system as described in claim 2, wherein, the feed point is arranged at one end, close to the first radiation gap, of the feed sheet.

4. The antenna system as described in claim 3, wherein, the first frequency band comprises 37 GHz, and the second frequency band comprises 28 GHz.

5. The antenna system as described in claim 1, wherein, the grounding foundation plate and the antenna assembly are integrally formed; the grounding foundation plate further comprises a metalized through hole electrically connected with the first conductive layer and the second conductive layer.

6. The antenna system as described in claim 1, wherein, a number of the antenna assemblies is multiple, and the antenna system is a phased array antenna system.

7. The antenna system as described in claim 6, wherein, the number of the antenna assembly is four, and the four antenna assemblies are arranged in a plane matrix mode.

8. A mobile terminal comprising an antenna system as described in claim 1.

* * * * *